US009854951B2

(12) United States Patent
Voorhorst et al.

(10) Patent No.: US 9,854,951 B2
(45) Date of Patent: Jan. 2, 2018

(54) VACUUM CLEANER HEAD

(71) Applicant: KONINKLIJKE PHILIPS N.V., Eindhoven (NL)

(72) Inventors: Fokke Roelof Voorhorst, Eindhoven (NL); Bastiaan Johannes De Wit, Eindhoven (NL); Arnoldus Cornelis Wessels, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/646,763

(22) PCT Filed: Oct. 7, 2014

(86) PCT No.: PCT/EP2014/071391

§ 371 (c)(1),
(2) Date: May 22, 2015

(87) PCT Pub. No.: WO2015/055458

PCT Pub. Date: Apr. 23, 2015

(65) Prior Publication Data

US 2016/0213215 A1 Jul. 28, 2016

(30) Foreign Application Priority Data

Oct. 17, 2013 (EP) ..... 13189015

(51) Int. Cl.

| | |
|---|---|
| ***A47L 9/02*** | (2006.01) |
| ***A47L 9/06*** | (2006.01) |
| ***A47L 9/00*** | (2006.01) |

(52) U.S. Cl.

CPC ..... *A47L 9/02* (2013.01); *A47L 9/009* (2013.01); *A47L 9/0606* (2013.01)

(58) Field of Classification Search

CPC ..... A47L 9/02; A47L 9/009; A47L 9/0606
See application file for complete search history.

(56) References Cited

U.S. PATENT DOCUMENTS

| | | | | |
|---|---|---|---|---|
| 2,807,825 | A | 10/1957 | Gardner | |
| 3,955,238 | A | 5/1976 | Remijas | |
| 6,484,357 | B1 | 11/2002 | Dong | |
| 7,200,893 | B2 | 4/2007 | Gerber | |
| 9,215,959 | B2 * | 12/2015 | Heidenga | A47L 9/04 |

(Continued)

FOREIGN PATENT DOCUMENTS

| | | | |
|---|---|---|---|
| CN | 101756673 | A | 6/2010 |
| CN | 202801479 | U | 3/2013 |

(Continued)

*Primary Examiner* — Robert Scruggs

(57) ABSTRACT

A vacuum cleaner head has a base and a suction opening in the base. An array of flexible flaps protrudes from the base. The flexible flaps are configured to act on a surface to be cleaned. The flexible flaps are spaced from each other to allow the passage of detritus therebetween in a predefined arrangement. The predefined arrangement of the flexible flaps is configured to promote a non-linear flow path through the array of flexible flaps between an end of the base and the suction opening. A gap between first and second rows of flaps is substantially equal to or greater than a space between adjacent flexible flaps in each of the first and second rows.

20 Claims, 3 Drawing Sheets

(56) References Cited

U.S. PATENT DOCUMENTS

| | | | | |
|---|---|---|---|---|
| 2002/0170140 | A1* | 11/2002 | Diaz | A47L 9/02 15/415.1 |
| 2003/0163889 | A1* | 9/2003 | Bagwell | A47L 9/02 15/398 |
| 2005/0066471 | A1* | 3/2005 | Miller | A47L 9/02 15/401 |

FOREIGN PATENT DOCUMENTS

| | | | |
|---|---|---|---|
| DE | 3444724 | A1 | 6/1986 |
| DE | 102008021353 | A1 | 11/2009 |
| GB | 293782 | A | 10/1928 |
| JP | 50031668 | A | 9/1976 |
| JP | 2000325273 | A | 11/2000 |
| JP | 2003000496 | A | 1/2003 |
| JP | 2006102367 | A | 4/2006 |
| JP | 3167137 | U | 4/2011 |
| JP | 2012040095 | A | 3/2012 |
| WO | 2005087073 | A1 | 9/2005 |
| WO | 2007025919 | A1 | 3/2007 |
| WO | 2009103141 | A1 | 8/2009 |
| WO | 2009133031 | A1 | 11/2009 |

* cited by examiner

VACUUM CLEANER HEAD

This application is the U.S. National Phase application under 35 U.S.C. §371 of International Application No. PCT/EP2014/071391, filed on Oct. 7, 2014, which claims the benefit of International Application No. 13189015.4 filed on Oct. 17, 2013. These applications are hereby incorporated by reference herein.

FIELD OF THE INVENTION

The present invention relates to a vacuum cleaner head. The present invention also relates to a vacuum cleaner comprising a vacuum cleaner head.

BACKGROUND OF THE INVENTION

Vacuum cleaners are commonplace in households and places of work. Such devices are generally used to remove food, dirt and hair from a surface, such as a floor. A vacuum cleaner generally operates by sucking air through a suction opening in a maneuverable head which causes a decrease in pressure at the surface to be cleaned. Air is therefore drawn through or along the surface to be cleaned and into the suction opening carrying detritus such as food, dirt and hair. This detritus is transported into the vacuum cleaner for removal.

However, the surfaces within a single household or place of work may vary. Such surfaces include a hard floor, for example a solid wood floor or concrete, or a soft floor, for example a carpet. Food, dirt and hair may become trapped in the fibres of a soft floor, such as a carpet, or in the crevices of a hard floor, such as a wood floor. Therefore, different vacuum cleaner head arrangements are required to provide a good cleaning performance on different types of floor.

It is known to provide a vacuum cleaner with different attachments to clean different types of floor. However, this requires a user to stop vacuuming and replace the vacuum cleaner attachment for each type of floor.

Another possible approach is to provide a vacuum cleaner head with an adjustable unit, for example a brush, which may be selectively deployed. This allows a user to selectively deploy the adjustable unit to maximise the performance on two different types of surface. However, this still involves the user having to stop vacuuming to make the adjustment and lowers performance of the vacuum cleaner on different surfaces.

DE3444724 discloses a floor suction nozzle for a vacuum cleaner which has at least one working edge of flexible construction running parallel to the suction channel of the nozzle. In order to achieve the full effectiveness of rigid working edges despite the flexible construction of the working edge, provision is made for both working edges bounding the suction channel to consist of flexible tongues formed by vertical slots, which tongues are rigid in the vertical direction and resilient in the horizontal direction.

SUMMARY OF THE INVENTION

It is an object of the invention to provide an improved vacuum cleaner head.

According to the present invention, there is provided a vacuum cleaner head comprising a base, a suction opening in the base and an array of flexible flaps protruding from the base configured to act on a surface to be cleaned, the flexible flaps being spaced from each other to allow the passage of detritus therebetween, wherein the flexible flaps are arranged in a predefined arrangement which is configured to promote a non-linear flow path through the array of flexible flaps between an end of the base and the suction opening.

In accordance with the present invention, a gap between first and second rows of flexible flaps is substantially equal to or greater than a spacing between adjacent flexible flaps in each of the first and second rows. Therefore, particles of detritus are able to pass between the rows of flexible flaps with limited impairment. This aids the passage of large particles to the suction opening.

With this arrangement it is possible to create a non-linear path to the suction opening which will help maximise air resistance and so ensure a high vacuum is generated by the vacuum cleaner head. Therefore, cleaning performance of the vacuum cleaner head is improved. Furthermore, the flexible flaps help to form a seal with the surface to be cleaned whilst allowing the passage of detritus to the suction opening.

The provision of flexible flaps may aid the dislodgement of detritus from a surface to be cleaned due to the resilience of the flaps. Furthermore, the flexible flaps are urged against the surface to be cleaned.

The array of flexible flaps may also help define an elongate air flow path between the end of the base and the suction opening that provides a high resistance to the passage of air to help maximise the detritus pick-up capabilities of the vacuum cleaner head.

The flexible flaps are arranged in at least first and second rows. The flexible flaps in the first row may be offset from the flexible flaps in the second row.

The width of each flexible flap in the first row may be configured to be substantially equal to or greater than a space between adjacent flexible flaps in the second row which is aligned with said flexible flap in the first row.

Each flexible flap may be configured to align with or partially overlap two or more flexible flaps. Each flexible flap in the first row may be configured to align with or partially overlap two or more flexible flaps in the second row. Therefore, the flexible flap is able to completely overlap the space in the adjacent row of flaps. This helps maximise the non-linearity of the path along which air flows through the array of flaps. Therefore, air resistance created by turbulence can be increased to maximise the vacuum generated at the base.

The width of the space between adjacent flexible flaps may be configured to be at least 50% of the width of each adjacent flexible flap. The spacing between adjacent flexible flaps may be configured to be substantially equal to the width of each adjacent flexible flap. With this arrangement it is possible for large particles of detritus to easily pass to the suction opening without being obstructed which will allow the particles to be removed from the surface. Therefore, it is possible for detritus to easily pass through the array of flexible flaps and be removed from the surface to be cleaned.

The length of each flexible flap may be between 50% and 200% of the width of said flexible flap, and optionally the length of each flexible flap may be substantially equal to the width of said flexible flap. Therefore, the flexible flaps have a width sufficient to form a seal against the surface to be cleaned when the flexible flaps are urged against the surface.

The flexible flaps may extend substantially parallel to each other. The first row and the second row of flexible flaps may extend substantially parallel to each other. The flexible flaps may extend substantially parallel to a front end of the base. The first row and the second row of flexible flaps may extend substantially parallel to a front end of the base. This arrangement aids a user to orientate the flexible flaps and the suction opening with respect to the section of the surface to be cleaned.

The vacuum cleaner head may further comprise a guide unit configured to space the base from the surface to be cleaned. This arrangement allows a minimum size of aperture formed by the spacing between adjacent flexible flaps to be maintained when the vacuum cleaner head is in use. The guide unit helps prevent the base from being drawn into abutment with the surface to be cleaned.

The flexible flaps may be configured to extend beyond the guide unit. This arrangement helps ensure that the flexible flaps are able to abut against the surface to be cleaned.

The guide unit may comprise a wheel unit configured to locate against the surface to be cleaned. This aids movement of the vacuum cleaner head over the surface to be cleaned.

The base may be configured to pivot about the guide unit between a forward condition when the head is drawn in a forward direction, and a rearwards condition when the head is drawn in an opposing direction. With this arrangement it is possible to vary the contact of the flexible flaps with the surface to be cleaned dependent on the direction of movement of the head. This feature would be advantageous even without the limitations in the independent claim on the relation between the gap between the rows and the spacing between adjacent flexible flaps.

Each row of flexible flaps may comprise a flap mount. The flexible flaps may extend from the flap mount, and optionally the flap mount may protrude from the base. This arrangement provides a simple means of forming the flaps and mounting the flaps to extend from the base. Furthermore, it is possible for the base mount to flex to provide greater resilience and/or movement to the flaps. In addition, the flap mount may be used to limit the area of the space between adjacent flaps.

The flexible flaps of each row may be integrally formed. The flap mount may be resilient. A base end of each flap may be configured to extend beyond the guide unit.

The base end of each flap in each row may align longitudinally along the row. This ensures a generally consistent contact between the row of flaps and the surface to be cleaned along its length.

The array of flexible flaps may be a first array of flexible flaps, and the vacuum cleaner head may further comprise a second array of flexible flaps on an opposing side of the suction opening to the first array of flaps. This provides for a non-linear path to the suction opening on opposing sides of the suction opening. Therefore, effective operation of the vacuum cleaner head may be maximised.

The flexible flaps may have a high coefficient of friction with hair. Therefore, the flexible flaps are able to effectively aid the removal of hair from the surface to be cleaned.

According to another aspect of the present invention, there is provided a vacuum cleaner comprising a vacuum cleaner head according to claim 1.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
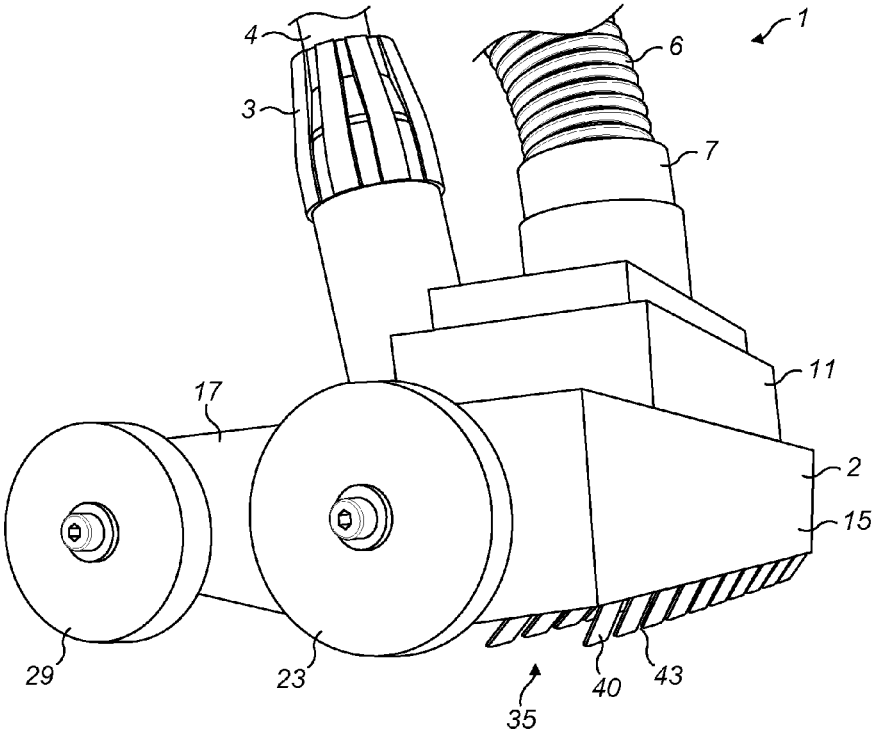
FIG. 1 shows a diagrammatic perspective view of part of a vacuum cleaner comprising a vacuum cleaner head.
Figure 2:
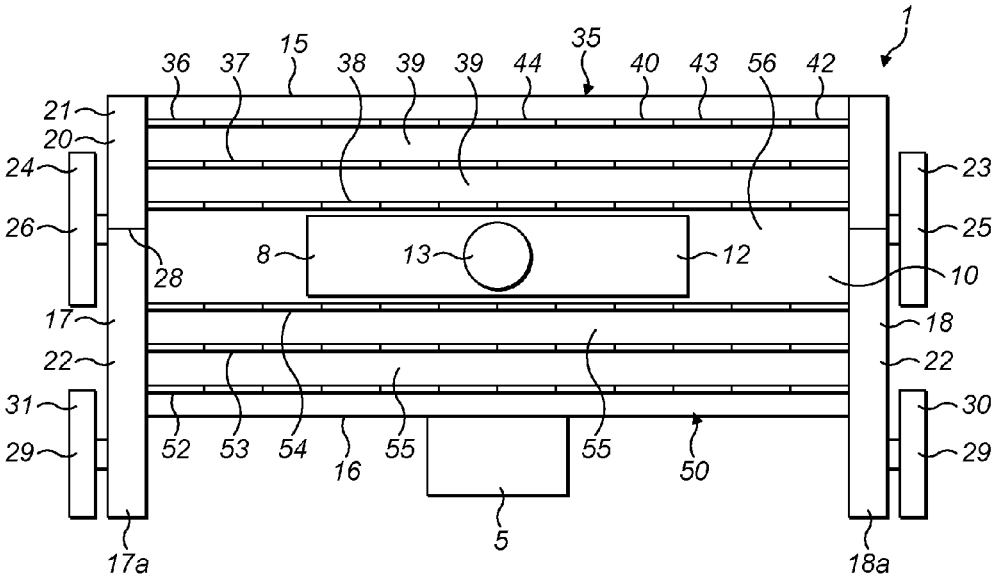
FIG. 2 shows a diagrammatic plan view of the vacuum cleaner head shown in FIG. 1.
Figure 3:
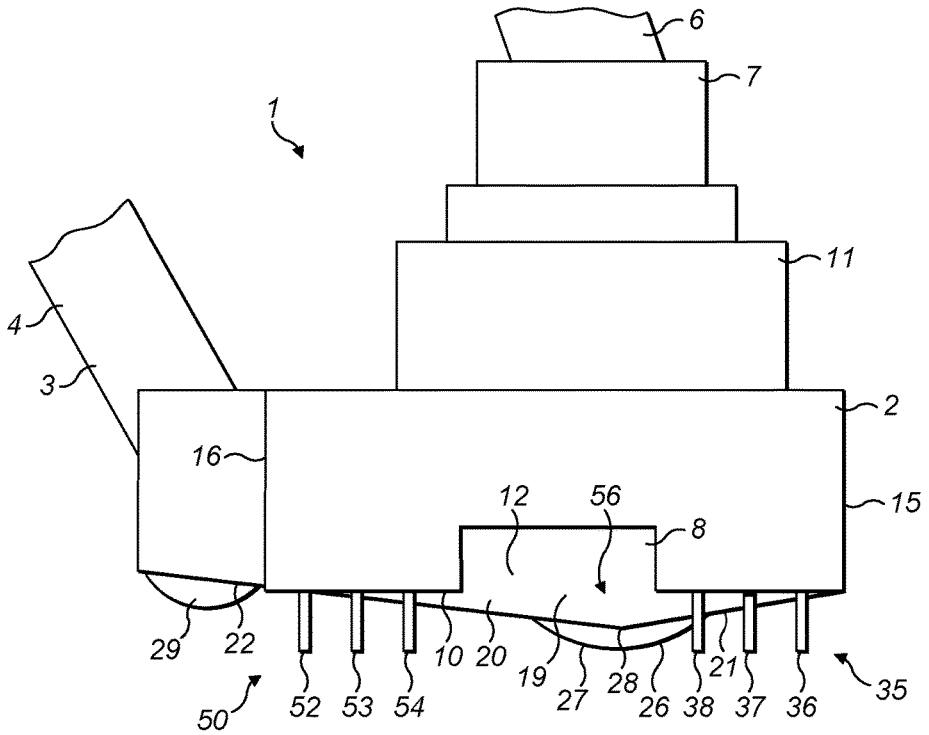
FIG. 3 shows a diagrammatic cut-away side view of the vacuum cleaner head shown in FIG. 1.
Figure 4:
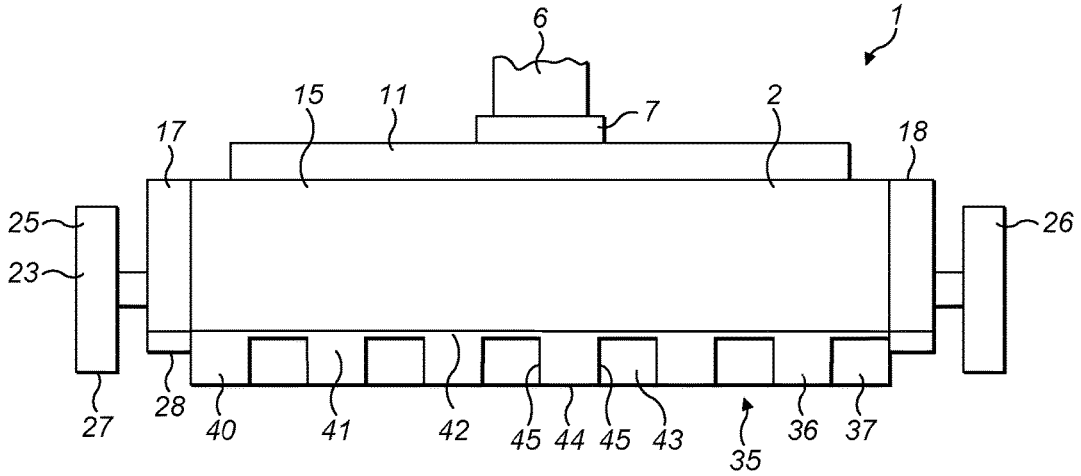
FIG. 4 shows a diagrammatic front view of the vacuum cleaner head shown in FIG. 1.

Referring to FIGS. 1 to 4, there is shown part of a vacuum cleaner 1. The vacuum cleaner is configured to remove detritus, such as dirt, debris, dust and hair, from a surface. Such a surface includes, but is not limited to a hard floor, for example a hard wood floor or concrete, or a soft floor, for example a carpet.

The vacuum cleaner 1 comprises a vacuum cleaner head 2 and a body unit 3. Only part of the body unit 3 is shown. The vacuum cleaner head 2 is connectable to the body unit 3. An elongate handle 4 is mounted to the vacuum cleaner head 2. The elongate handle 4 allows a user to manoeuvre the vacuum cleaner head 2 on a surface to be cleaned.

The vacuum cleaner head 2 is pivotably mounted to the elongate handle 4 by a pivot joint 5. The pivot joint 5 allows the vacuum cleaner head 2 to pivot relative to the handle 4, and therefore the body unit 3. Furthermore, the pivot joint 5 allows the head 2 to be correctly orientated with respect to a surface to be cleaned. The elongate handle 4 is mounted to a rear part of the head 2.

A suction hose 6 extends from the vacuum cleaner head 2. The suction hose 6 fluidly communicates the body unit 3 and the head 2. The suction hose 6 is connected to a suction outlet 7 on the head 2. The suction hose 6 and elongate handle 4 are fixedly mountable to the head 2. That is, the suction hose 6 is removably mounted to the suction outlet 7. The suction hose 6 is fixedly mounted to the body unit 3 at a distal end of the hose 6.

The body unit 3 comprises a suction unit (not shown). The suction unit (not shown) comprises a vacuum pump (not shown), acting as a suction means, a detritus collector (not shown), for example a detritus chamber and a filter, and an air outlet (not shown). Such an arrangement is conventional and so a detailed description will be omitted herein. The suction hose 6 is fluidly connected to the suction unit in the body unit 3 to generate suction in the vacuum cleaner head 2. The suction outlet 7 communicates with a suction opening 8 in the vacuum cleaner head 2 through which detritus is drawn into the vacuum cleaner head 2.

It will be understood that alternative arrangements are possible. For example, the suction unit (not shown) may be in the head 2. Furthermore, the elongate handle 4 and suction hose 6 may be integrated, or the vacuum cleaner 1 may be integrated into an upright configuration.

The vacuum cleaner head 2 comprises a base 10 and an upper housing 11. The base 10 forms a lower end of the vacuum cleaner head 2 and is configured to be positioned against a surface to be cleaned. The suction opening 8 is formed in the base 10. The suction opening 8 comprises a suction recess 12 extending in the base 10 and a suction path 13 extending from the suction recess 12 to the suction outlet 7 on the upper side of the vacuum cleaner head 2. The base 10 is generally planar, although alternative configurations are envisaged.

The base 10 has a front end 15 and a rear end 16. In the present embodiment, the front face 15 and rear face 16 extend parallel to each other. The suction recess 12 is elongate. The suction recess 12 extends parallel to the front end 15 of the head 2. The front end 15 of the base 10 has a linear profile. However, it will be understood that the front end 15 may have an alternative configuration, for example arcuate. The rear end 16 also has a linear profile. However, it will be understood that the rear end 16 may have an alternative configuration, for example arcuate.

The head 2 has opposing left and right side portions 17, 18. The left side portion 17 extends on one side of the head 2, and the right side portion 18 extends on the other side of the head 2. The side portions 17, 18 extend between the front end 15 and the rear end 16 of the base 10. Each side portion 17, 18 has a rear extended section 17*a*, 18*a* extending outwardly from the rear end 16 of the base 10. The left and right side portions 17, 18 form left and right side walls on opposing sides of the base 10. The side portions 17, 18 each have an end section 19. The end sections 19 protrude from the base 10. Each end section 19 has a lower end 20.

The lower end 20 of each end section 19 has a front face 21 and a rear face 22. The lower end 20 of each end section 19 is spaced from the base 10. Each front face 21 is inclined at an angle to the rear face 22. The front faces 21 extend on a plane to define a front surface, and the rear faces 22 extend on a plane to define a rear surface. The front surface extends at an oblique angle to the base 10. The front surface converges towards the base 10 towards the front end 15 of the base 10. The rear surface converges towards the base 10 towards the rear end 16 of the base 10. The rear surface extends at an oblique angle to the base 10. In an alternative embodiment the lower end 20 of each end section 19 has a single surface, for example a planar or arcuate surface. The inclined front and rear surfaces at the lower end 20 of each protruding end section 19 allows the head 2 to be tilted both forwards and rearwards on a surface to be cleaned when the head 2 is rotated. The inclined surfaces help restrict the protruding end sections 19 from impacting against the surface to be cleaned which may catch and/or cause damage to the surface to be cleaned. The inclined surfaces also help restrict air flow from each side of the base 10.

A first set of wheels 23 is rotatably mounted to the head 2. The first set of wheels 23 forms part of a guide unit 24. The guide unit 24 spaces the base 10 from the surface to be cleaned when the head 2 is disposed on the surface. The guide unit 24 is also configured to allow the head 2 to be easily drawn across the surface to be cleaned.

The first set of wheels 23, also known as a first wheel unit, comprises a first left wheel 25 rotatably mounted to the left side portion 17 and a first right wheel 26 rotatably mounted to the right side portion 18. A part of the first set of wheels 23 extends below the lower end 20 of the end sections 19. The first set of wheels 23 are disposed against the surface to be cleaned, and roll along the surface to be cleaned, when the head 2 is located on the surface. The distance between the base 10 and a distal part 27 of the first set of wheels 23 defines the maximum spacing between the base 10 and the surface to be cleaned.

The first set of wheels 23 is rotatably mounted towards the front end 15 of the base 10. The first set of wheels 23 is spaced from the front end 15. The first set of wheels 23 is aligned with the juncture 28 of the front and rear surfaces at the lower end 20 of each protruding end section 19. Therefore, the front and rear surfaces at the lower end 20 of each protruding end section 19 pivot about the first set of wheels 23. The first set of wheels 23 define a pivot axis about which the head 2 is able to pivot relative to the surface to be cleaned.

A second set of wheels 29 is rotatably mounted to the head 2. The second set of wheels 29 forms part of the guide unit 24. The second set of wheels 29 comprises a second left wheel 30 rotatably mounted to the left side portion 17 and a second right wheel 31 rotatably mounted to the right side portion 18. A part of the second set of wheels 29 extends below the lower end 20 of the end sections 19. The second set of wheels 29 extend below the rear surface at the lower end 20 of each protruding end section 19. The second set of wheels 29 spaces the rear surface at the lower end 20 of each protruding end section 19 from a surface to be cleaned.

The second set of wheels 29, also known as a second wheel unit, is rotatably mounted towards the rear end 16 of the base 10. The second set of wheels 29 is spaced from the first set of wheels 23. The second set of wheels 29 are rotatably mounted to the rear extended section 17*a*, 18*a* extending outwardly from the rear end 16 of the base 10. Therefore, the first and second set of wheels 23, 29 are able to locate against the surface to be cleaned when the head 2 is in one orientation. The second set of wheels 29 have a smaller diameter than the first set of wheels 23.

In an alternative embodiment the second set of wheels 29 may be omitted. Alternatively, both the first and second set of wheels 23, 29 may be omitted and the protruding end sections 19 may form the guide unit. In such an embodiment the lower ends 20 of the protruding end surfaces are configured to restrict resistance against drawing the protruding end sections 19 along a surface to be cleaned. It will also be understood that the protruding end sections 19 also form part of the guide unit 24 in an arrangement with one or more sets of wheels.

A first array of flaps 35 protrudes from the base 10 of the vacuum cleaner head 2. The first array of flaps 35 extends downwardly from the base 10. The first array of flaps 35 is disposed between the front end 15 of the base 10 and the suction opening 8.

The first array of flaps 35 extends parallel to the front end 15 of the base 10. The first array of flaps 35 extends across the base 10 between the opposing left and right side portions 17, 18. The first array of flaps 35 is disposed in rows. The first array of flaps 35 comprises first, second and third rows 36, 37, 38 of flaps. Although three rows 36, 37, 38 of flaps are described in the present embodiment, it will be understood that in an alternative embodiment the first array of flaps 35 may comprise two rows of flaps only, or four or more rows of flaps. For example, the first row 36 of flaps may be omitted such that the second and third rows 37, 38 are retained.

The three rows 36, 37, 38 of flaps are spaced from each other. The three rows 36, 37, 38 of flaps extend parallel to each other. The first row 36 of flaps is disposed proximate to the front end 15 of the base 10. In one embodiment the first row 36 of flaps is disposed at the front end 15. The second row 37 of flaps is disposed adjacent to the first row 36 of flaps. The second row 37 is spaced from the first row 36 by a gap 39. The third row 38 of flaps is disposed proximate to the suction opening 8. In one embodiment the third row 38 of flaps is disposed at the suction opening 8. The third row 38 is spaced from the second row 37 by another gap 39. The second row 37 is disposed between the first row 36 and the third row 38.

The first array of flaps 35 comprises a plurality of flaps 40. Each row 36, 37, 38 has a line of flaps 40. Each flap 40 is flexible. Each flap 40 is resilient. In the present embodiment the flaps 35 are formed from rubber.

The flaps 40 are formed from a sheet of sheet material. In the present embodiment the flaps 40 in each row 36, 37, 38 are integrally formed with each other, however it will be understood that the flaps may be individually formed or formed in smaller groups of flaps. Each flap 40 is formed from a planar strip of material. A base end 41 of each flap 40 is aligned with the longitudinal alignment of the respective row of flaps. For example, when in a linear row of flaps 40, the base end 41 of each flap is aligned on a linear arrangement. Each flap is attached at one side.

The flaps 40 in each row extend from a base mount 42. The base mount 42 is an elongate member extending across the base. The base mount 42 connects the flaps 40 to the base 10. The base end 41 of each flap 40 is connected to the base mount 42. In the present embodiment the base mount 42 and respective flaps 40 are integrally formed. The base mount 42 protrudes from the base 10. In an alternative embodiment the base mount 42 is omitted and the base end 41 of each flap 40 directly extends from the base 10. Each flap may be hinged about its base end 41. The base mount 42 is flexible. The base mount 42 provides a simple means of mounting the flaps 40 to the base 10.

In an undeformed state the flaps 40 protrude perpendicularly from the base 10, although the flaps 40 may extend at an oblique angle. The flaps 40 are evenly spaced along each row 36, 37, 38. A space 43 is defined between adjacent flaps 40 in each row 36, 37, 38. Adjacent flaps 40 are spaced by the space 43. The width of each space 43 corresponds to the width of the flaps 40. In the present embodiment the width of each space 43 is substantially equal to the width of each flap 40.

Each flap 40 has the base end 41 and a free end 44. Opposing side edges 45 of the flap 40 extend between the base end 41 and the free end 44. The free ends 44 of the flaps 40 in each row 36, 37, 38 are aligned with each other. The free end 44 of each flap 40 has a linear profile. This aids the abutment and sealing of the flaps 40 against a surface to be cleaned. The length of each flap 40 is generally equal to the width of each flap 40.

In the present embodiment the width of each flap 40 is about 10 mm. The length of each flap 40 is about 10 mm. Therefore, the depth of each space 43 between adjacent flaps 40 is about 10 mm. The width of each space 43 is about 10 mm. However, it will be understood that the dimensions of the flaps 40 and spaces 43 may vary.

The space 43 between adjacent flaps 40 is configured to allow the passage of large particles of detritus typically found on a surface to be cleaned, for example a domestic floor, to pass through the space 43 without obstruction.

The flaps 40 of the second row 37 are offset from the flaps 40 of the first row 36. Therefore, the flaps 40 in adjacent rows do not lie parallel with each other. The flaps 40 of the second row 37 overlap the spaces 43 formed in the first row 36. Therefore, the flaps 40 in the second row 37 obstruct a direct path from the spaces 43 in the first row 36 to the suction opening 8 in the base 10. Similarly, the flaps 40 of the first row 36 overlap the spaces 43 formed in the second row 37. Therefore, there in no direct path from the front end 15 of the head 2 to the suction opening 8.

The above arrangement defines a non-linear flow path through the first array 35 of flexible flaps 40 between the front end 15 of the base 10 and the suction opening 8.

The flaps 40 of the third row 38 are aligned with the flaps of the first row 36. Therefore, the flaps 40 of the third row 38 overlap the spaces 43 formed in the second row 37 and so obstruct a direct path from the spaces 43 in the second row 37 to the suction opening 8 in the base 10. This further increases the non-linear flow path through the first array 35 of flexible flaps 40 between the front end 15 of the base 10 and the suction opening 8.

In the present embodiment the width of each space 43 is substantially equal to the width of each flap 40. Therefore, the side edge 45 of one flap 40 in one row is aligned with the edge 45 of one flap 40 in the adjacent row. However, in another embodiment the width of each space 43 is less than the width of each flap 40. In such an embodiment one flap 40 in one row partially overlaps two flaps 40 in the adjacent row. That is, the side edges of one flap 40 in one row overlaps side edges of two adjacent flaps 40 in the adjacent row. Therefore, the change of direction of air as it passes through the rows of flaps 40 is increased.

A second array of flaps 50 protrudes from the base 10 of the vacuum cleaner head 2. The second array of flaps 50 extends downwardly from the base 10. The second array of flaps 50 is disposed between the rear end 16 of the base 10 and the suction opening 8. Therefore, the second array of flaps 50 is disposed on an opposing side of the suction opening 8 to the first array of flaps 35.

A suction space 56 is defined between the first and second array of flaps 35, 50. The cavity is closed at either end by the end sections 19 of the left and right side portions 17, 18.

The arrangement of the second array of flaps 50 is generally the same as the arrangement of the first array of flaps 35 and so a detailed description will be omitted herein. The second array of flaps 50 extends parallel to the rear end 16 of the base 10. The second array of flaps 50 extends across the base 10 between the opposing left and right side portions 17, 18. The second array of flaps 50 is disposed in rows. The second array of flaps 50 comprises fourth, fifth and sixth rows 52, 53, 54 of flaps. Although three rows 52, 53, 54 of flaps are described in the present embodiment, it will be understood that in an alternative embodiment the second array of flaps 50 may comprise two rows of flaps only, or four or more rows of flaps.

The three rows 52, 53, 54 of flaps are spaced from each other by gaps 55. The three rows 52, 53, 54 of flaps extend parallel to each other. The fourth row 52 of flaps is disposed proximate to the rear end 16 of the base 10 and sixth row 54 of flaps is disposed proximate to the suction opening 8.

The arrangement of the flaps 40 and spaces 43 forming each row 52, 53, 54 of flaps of the second array of flaps 50 is the same as the arrangement of the flaps 40 and spaces 43 of the first array of flaps 35 and so a detailed description will be omitted.

When the body 2 is disposed on a surface to be cleaned the base 10 opposes the surface. The base 10 is spaced from the surface by the guide unit 24 including the first set of wheels 23 resting on the surface. This prevents the flaps 40 from being fully deformed due to the weight of the body 2.

The flaps 40 of the first array of flaps 35 extend beyond the guide unit 24, in this embodiment out from the front surface at the lower end 20 of each end section 19. The flaps 40 of the second array of flaps 50 extend beyond the guide unit 24, in this embodiment out from the rear surface at the lower end 20 of each end section 19. The free end 44 of each flap 40 of the first and second arrays 35, 50 of flaps locates against the surface to be cleaned. As the flaps 40 are resilient they are urged against the surface to be cleaned. Due to their flexibility the flaps 40 deform to form a good contact with the surface to be cleaned.

When the flaps 40 locate against the surface to be cleaned, apertures are formed by the spaces 43 between adjacent flaps 40 in each row 36, 37, 38, 52, 53, 54. The apertures defined by each row 36, 37, 38 of the first array of flaps 35 define a flow path between the front end 15 of the base 10 and the suction opening 8. The apertures defined by each row 52, 53, 54 of the second array of flaps 50 define a flow path between the rear end 16 of the base 10 and the suction opening 8.

The suction space 56 defined between the first and second arrays 35, 50 of flaps communicates with the suction opening 8. The head 2 is initially in a neutral condition with the flaps 40 of both the first and second arrays of flaps 35, 50 being urged against the surface to be cleaned due to their resilience. Therefore, the plane of the base 10 lies substantially parallel to the surface to be cleaned in the neutral condition.

When the vacuum cleaner 1 is operated, air is drawn in through the suction opening 8 in the base 10. A reduction in pressure is therefore generated in the suction space 56. Air is therefore drawn through the first array of flaps 35 and the second array of flaps 50.

The arrangement of the rows 36, 37, 38 of the first array 35 causes an air resistance from the front end 15 of the base 10 to the suction space 56. That is, for example, the spaces 43 in the second row 37 are offset from the spaces 43 formed in the first row 36. Therefore, the inflowing air is forced to change direction as the air passes through the first array 35. The change of direction around the flaps 40 causes turbulence. As the turbulence increases so does the air resistance of the system. This turbulence increases the pressure difference occurring between front end 15 of the base 10 and between the base 10 and the surface to be cleaned. This therefore promotes an increased suction on detritus to be removed from the surface to be cleaned.

The arrangement of the rows 52, 53, 54 of the second array 50 causes air resistance from the rear end 16 of the base 10 to the suction space 56. Therefore, the inflowing air is forced to change direction as the air passes through the second array 50. The change of direction around the flaps 40 causes turbulence. As the turbulence increases so does the air resistance of the system. This turbulence increases the pressure difference occurring between rear end 16 of the base 10 and between the base 10 and the surface to be cleaned. This therefore promotes an increased suction on detritus to be removed from the surface to be cleaned and urges air flow through the carpet or recesses in the surface to provide a deeper cleaning effect.

The width of the space 43 between flaps 40 allows large particles of detritus to pass through the rows of flaps without obstruction. Therefore, large particles of detritus are not trapped by the arrays of flaps 35, 50, or prevented from entering the area of reduced pressure between the base 10 and the surface to be cleaned, for example by a brushing motion.

The gap 39 between adjacent rows 36, 37, 38 allows the passage of detritus between the rows 36, 37, 38 of flexible flaps without obstruction. The width of the gap 39 between adjacent rows 36, 37, 38 of flaps is generally the same as the width of the spaces 43 between adjacent flaps 40 in each row 36, 37, 38. Therefore, particles of detritus passing between the flaps 40 do not become lodged between adjacent rows of flaps 36, 37, 38.

The flaps 40 are urged against the surface to be cleaned. This provides at least a partial seal with the surface to be cleaned and so helps to increase the pressure reduction in the suction space 56 below the base 10. The flexibility of the flaps 40 allows the flaps to adjust to the surface to be cleaned, and to locate in any indents or recesses, or move over any ridges or other raised sections of the surface to be cleaned. Therefore, the flaps 40 remain in abutment with the surface. This aids operation of the vacuum cleaner head 2 on different floor types. For example, on a hard floor, such as a solid wood floor, the flaps 40 are able to locate against the hard surface to form a seal therewith. Furthermore, the flaps 40 are able to locate contours of the surface to be cleaned. This aids the removal of detritus from the recesses. On a soft floor, for example carpet, distance between the base 10 and the upper level of the surface may be increased due to the pile of the carpet, and the wheels digging into the carpet due to the weight of the vacuum cleaner 1. Therefore, the flexibility of the flaps 40 allow the flaps to adjust to the change in distance without any issues. Furthermore, the resilience of the flaps 40 allows the flaps 40 to be urged against and form a better seal with the fibres of the carpet and therefore improve cleaning efficiency.

When the vacuum cleaner head 2 is moved over a surface to be cleaned the free end 44 of each flap 40 lies in abutment with the surface and slides over the surface. The flaps 40 flex as they pass over a surface and so act against any detritus on the surface. For example, on a soft floor type the flaps 40 are urged against fibres and are able to flick up dirt from between the fibres via mechanical agitation. This aids removal of the detritus from the surface. The flaps 40 also have a high friction coefficient with hair to remove it from the surface.

It will be understood that the head 2 is configured to be moved in a forwards direction, that is in the direction of the front end 15 of the head 2, and in a rearwards direction, that is in the direction of the rear end 16 of the head 2. The user is able to manoeuvre the head 2 through use of the elongate handle 4.

Figure 5:
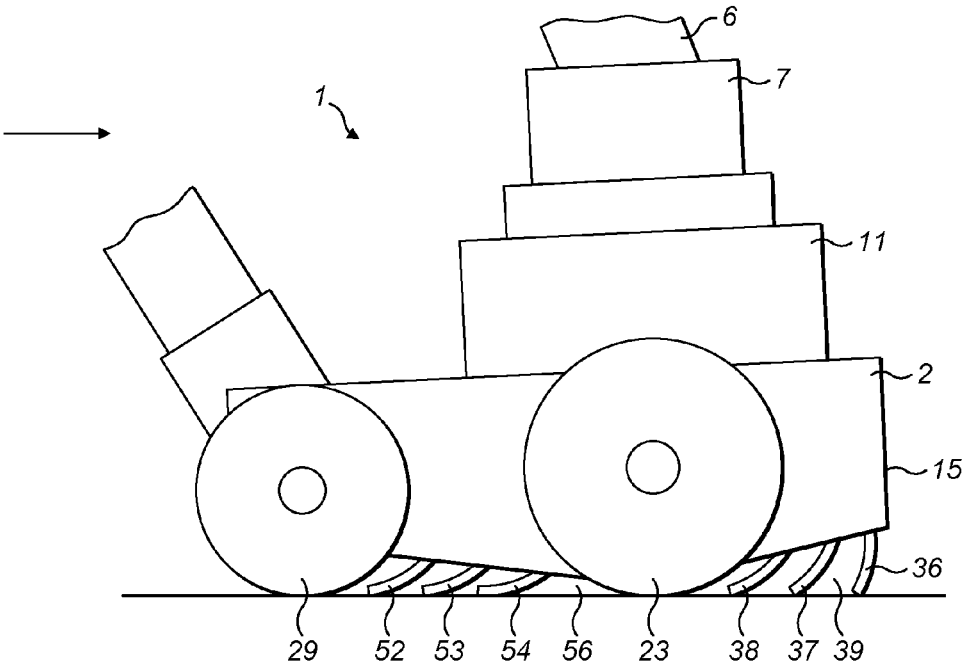
FIG. 5 shows a diagrammatic cut-away side view of the vacuum cleaner head shown in FIG. 3 being drawn in a forward direction on a surface to be cleaned.

When a user urges the head 2 to move in its forwards direction, the user pushes on the handle 4. As the handle is disposed at the rear end 16 of the head 2, that is rearwards of the pivot axis of the head 2, the rear end 16 of the base is urged towards the surface to be cleaned. This causes the base 10 of the head 2 to tilt relative to the surface to be cleaned into a forwards condition. Such a forwards condition is shown in FIG. 5. In the present embodiment the tilting of the head 2 is restricted in the forwards condition by the second set of wheels 29 acting as an end stop. However, it will also be understood that in an alternative embodiment the tilting is restricted by the lower end 20 of the end sections 19 acting as the end stop. The second set of wheels 29, together with the first set of wheels 23, aid movement of the head 2 over the surface to be cleaned in a forwards condition.

In the forwards condition the flaps 40 of the first array of flaps 35 are moved in a direction away from surface to be cleaned. Therefore, the area of each aperture formed by the spaces 43 between the flaps 40 is maximised. This allows coarse particles of detritus to more easily pass through the first array 35 to be removed through the suction opening 8. As the tilting of the head 2 is restricted, the flaps 40 of the first array of flaps remain in contact with the surface to be cleaned. This helps maintain a high level of suction, for example, through the carpet or crevices.

The flaps 40 of the second array of flaps 50 are moved in a direction towards the surface to be cleaned in the forward condition. Therefore, the flaps 40 are urged further against the surface and urged to flex. As flaps 40 of the second array 50 flex, the area of the apertures formed by the spaces 43 between the flaps 40 of the second array 50 is minimised. This decreases the flow of air through the second array of flaps 50. Therefore, the resistance, and therefore pressure difference, across the second array 50 between the rear end 16 and the suction space 56 is maximised. Therefore, detritus is more easily removed through the suction opening 8 from the suction space 56 and the flow of air and detritus through the first array 35 is maximised.

Figure 6:
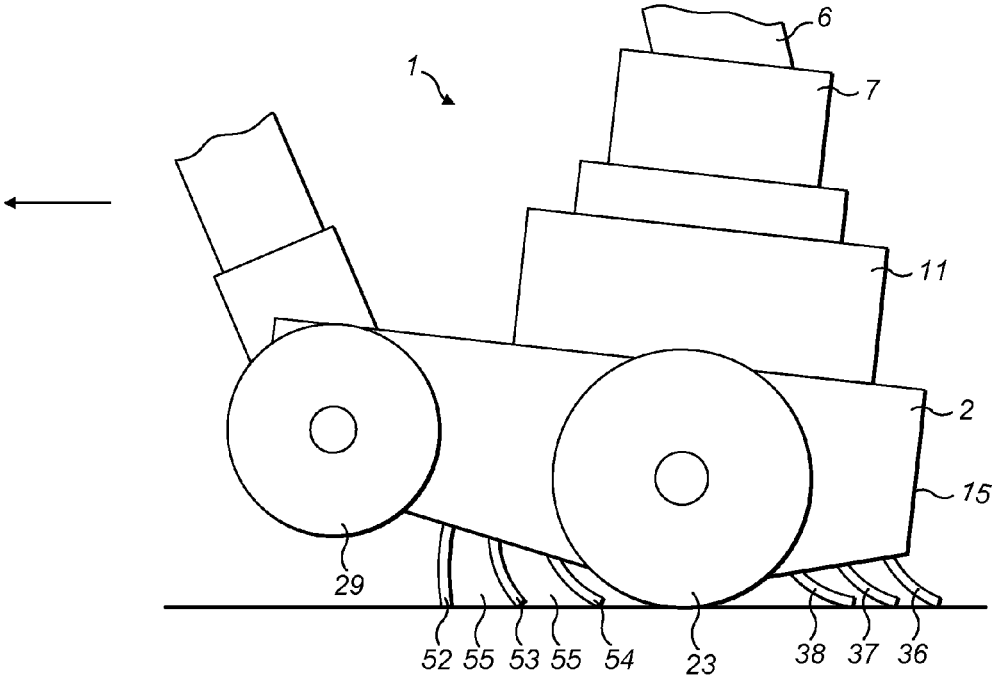
FIG. 6 shows a diagrammatic cut-away side view of the vacuum cleaner head shown in FIG. 3 being drawn in a backward direction on a surface to be cleaned.

When a user urges the head 2 to move in its rearwards direction, the user pulls on the handle 4. As the handle is disposed at the rear end 16 of the head 2, that is rearwards of the pivot axis of the head 2, the rear end 16 of the base is drawn away from the surface to be cleaned. This causes the base 10 of the head 2 to tilt relative to the surface to be cleaned into a rearwards condition. Such a rearwards condition is shown in FIG. 6. In the present embodiment the tilting of the head 2 is restricted in the rearwards condition by the resilience of the flaps and/or the lower end 20 of the end sections 19 acting as the end stop. The first set of wheels 23 aid movement of the head 2 over the surface to be cleaned in a rearwards condition.

In the rearwards condition the flaps 40 of the second array of flaps 50 are moved in a direction away from surface to be cleaned. Therefore, the area of each aperture formed by the spaces 43 between the flaps 40 is maximised in the second array 50. This allows coarse particles of detritus to more easily pass through the second array 50 to be removed through the suction opening 8. As the tilting of the head 2 is restricted, the flaps 40 of the second array of flaps 50 remain in contact with the surface to be cleaned. This helps maintain a high level of suction.

The flaps 40 of the first array of flaps 35 are moved in a direction towards the surface to be cleaned in the rearwards condition. Therefore, the flaps 40 are urged further against the surface and urged to flex. As flaps 40 of the first array 35 flex, the area of the apertures formed by the spaces 43 between the flaps 40 of the first array 35 is minimised. This decreases the flow of air through the first array of flaps 35. Therefore, the resistance, and therefore pressure difference, across the first array 35 between the front end 15 and the suction space 56 is maximised. Therefore, detritus is more easily removed through the suction opening 8 from the suction space 56 and the flow of air and detritus through the second array 50 is maximised.

Due to the spacing of the flaps 40 from each, other accumulation of detritus, such as dust or fibres, below the base 10 of the head 2 is reduced. Therefore, it is not necessary for a user to clean the base 10 of the head 2. The formation of the flaps 40 from a sheet of sheet material also reduces the accumulation of detritus.

Although a number of flaps are shown in each row in the Figures, it will be understood that the number of flaps in each row of flaps may vary. The rows do not need to be straight rows; for example, curved rows are alternatively possible. What matters is not the shape of the rows but that a gap 39 between the first and second rows 36, 37 is substantially equal to or greater than a space 43 between adjacent flexible flaps 40 in each of the first and second rows.

Although in the present embodiment the vacuum cleaner head 2 is configured to pivot relative to the surface to be cleaned about a pivot axis, it will be understood that in an alternative embodiment the head 2 is configured to remain at a consistent angle relative to the surface to be cleaned during use. For example, the head 2 may be configured to rest on the surface to be cleaned through the first and second wheels during use. In such an embodiment the base 10 may lie parallel to the surface to be cleaned during use.

Although in the present embodiments the vacuum cleaner head 2 comprises a first array of flaps 35 towards a front end 15 of the base 10, and a second array of flaps 50 towards a rear end 16 of the base 10, it will be understood that in an alternative arrangement one of the array of flaps may be omitted or replaced by an alternative arrangement. For example, in one arrangement the second array of flaps 50 may be omitted and replaced by a resilient pad or sheet of material without any flaps formed in it.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A vacuum cleaner head comprising:

a base having suction opening, a front end and a rear end, the rear end being opposite the front end; and flexible flaps protruding from one of the front end and the rear end of the base and configured to act on a surface to be cleaned, the flexible flaps being spaced from each other to allow the passage of detritus therebetween, wherein the flexible flaps are arranged in a predefined arrangement which is configured to promote a non-linear flow path through the flexible flaps between an end of the base and the suction opening, the flexible flaps being arranged in at least first and second adjacent rows, wherein a gap along an axis perpendicular to the first and second adjacent rows and between the first and second adjacent rows is substantially equal to or greater than a space between adjacent flexible flaps in each of the first and second adjacent rows.

2. The vacuum cleaner head according to claim 1, wherein the flexible flaps in the first row are offset from the flexible flaps in the second row.

3. The vacuum cleaner head according to claim 2, wherein a width of each flexible flap in the first row is configured to be substantially equal to or greater than the space between adjacent flexible flaps in the second row which is aligned with said flexible flap in the first row.

4. The vacuum cleaner head according to claim 1, wherein each flexible flap is configured to align with or partially overlap two or more flexible flaps.

5. The vacuum cleaner head according to claim 1, wherein a width of the space between adjacent flexible flaps is configured to be at least 50% of a width of each adjacent flexible flap.

6. The vacuum cleaner head according to claim 1, wherein a length of each flexible flap is between 50% and 200% of a width of said flexible flap.

7. The vacuum cleaner head according to claim 1, wherein the flexible flaps extend substantially parallel to each other.

8. The vacuum cleaner head according to claim 1, further comprising a guide unit configured to space the base from the surface to be cleaned.

9. The vacuum cleaner head according to claim 8, wherein the guide unit comprises a wheel unit configured to locate against the surface to be cleaned.

10. The vacuum head according to claim 8, wherein the base is configured to pivot about the guide unit between a forward condition when the vacuum cleaner head is drawn in a forward direction, and a rearwards condition when the vacuum cleaner head is drawn in an opposing direction.

11. The vacuum cleaner head according to claim 1, wherein each row of flexible flaps comprises a flap mount, wherein the flexible flaps extend from the flap mount.

12. The vacuum cleaner head according to claim 1, wherein the flexible flaps are arranged in a first array of flexible flaps and a second array of flexible flaps, the first array and the second array being on opposing sides of the suction opening.

13. The vacuum cleaner head according to claim 1, wherein the flexible flaps have a high coefficient of friction with hair.

14. The vacuum cleaner head according to claim 1, wherein a length of each flexible flap is substantially equal to a width of said flexible flap.

15. The vacuum cleaner head according to claim 1, wherein the flexible flaps extend substantially parallel to the front end of the base.

16. The vacuum cleaner head according to claim 1, further comprising a guide unit configured to space the base from the surface to be cleaned, wherein the flexible flaps are configured to extend beyond the guide unit.

17. The vacuum cleaner head according to claim 1, wherein each row of flexible flaps comprises a flap mount, wherein the flexible flaps extend from the flap mount, and wherein the flap mount protrudes from the base.

18. A vacuum cleaner comprising a vacuum cleaner head, the vacuum cleaner head including:

a base having suction opening, a front end and a rear end, the rear end being opposite the front end; and flexible flaps protruding from one of the front end and the rear end of the base and configured to act on a surface to be cleaned, the flexible flaps being spaced from each other to allow the passage of detritus therebetween, wherein the flexible flaps are arranged in a predefined arrangement which is configured to promote a non-linear flow path through the flexible flaps between an end of the base and the suction opening, the flexible flaps being arranged in at least first and second adjacent rows, and wherein a gap along an axis perpendicular to the first and second adjacent rows and between the first and second adjacent rows is substantially equal to or greater than a space between adjacent flexible flaps in each of the first and second adjacent rows.

19. A vacuum cleaner head comprising:

a base having suction opening, a front end and a rear end, the rear end being opposite the front end; and flexible flaps protruding from one of the front end and the rear end of the base and configured to act on a surface to be cleaned, the flexible flaps being spaced from each other to allow the passage of detritus therebetween, the flexible flaps being arranged in at least first and second adjacent rows, wherein a gap along an axis perpendicular to the first and second adjacent rows and between the first and second adjacent rows is substantially equal to or greater than a space between adjacent flexible flaps in each of the first and second adjacent rows.

20. The vacuum cleaner head of claim 19, wherein the flexible flaps are arranged in a predefined arrangement which is configured to promote a non-linear flow path through the flexible flaps between an end of the base and the suction opening.

* * * * *